United States Patent [19]

Kasahara et al.

[11] Patent Number: 4,733,269

[45] Date of Patent: Mar. 22, 1988

[54] CONTROL SYSTEM FOR COLOR COPIER

[75] Inventors: Nobuo Kasahara, Yokohama; Tadahide Sawamura, Tokyo, both of Japan

[73] Assignee: Ricoh Company, Ltd., Tokyo, Japan

[21] Appl. No.: 12,492

[22] Filed: Feb. 9, 1987

[30] Foreign Application Priority Data

Feb. 13, 1986 [JP] Japan ..... 61-29618

[51] Int. Cl.[4] ..... G03G 15/01

[52] U.S. Cl. ..... 355/4; 355/14 TR; 118/645; 430/54; 430/199; 430/357

[58] Field of Search ..... 355/4, 14 R, 14 TR, 355/3 TR, 14 SH, 3 SH, 14 C; 118/645; 430/48, 54, 199, 357

[56] References Cited

U.S. PATENT DOCUMENTS

| | | | |
|---|---|---|---|
| 4,260,248 | 4/1981 | Murata et al. | 355/14 C X |
| 4,571,055 | 2/1986 | Nishyama | 355/3 SH X |
| 4,571,067 | 2/1986 | Nishiyama | 358/3 SH X |
| 4,589,035 | 5/1986 | Yamanishi et al. | 355/4 X |
| 4,660,961 | 4/1987 | Kuramoto et al. | 355/4 |
| 4,682,880 | 7/1987 | Fujii et al. | 355/4 |

FOREIGN PATENT DOCUMENTS

| | | |
|---|---|---|
| 2344049 | 8/1973 | Fed. Rep. of Germany . |
| 2826583 | 4/1983 | Fed. Rep. of Germany . |
| 2535952 | 11/1985 | Fed. Rep. of Germany . |

*Primary Examiner*—A. C. Prescott

*Attorney, Agent, or Firm*—Oblon, Fisher, Spivak, McClelland & Maier

[57] ABSTRACT

A control device for a color copier which sets up an adequate color copying time for any particular size of transfer papers. A color document is repeatedly scanned by a scanning optical system to sequentially expose a single photoconductive drum, which is rotated at a constant speed, to a plurality of separated color components. Each of the latent images electrostatically formed on the drum is developed by a toner which is supplied from a developing device and complementary in color to the color component associated with the latent image, the resulting toner images being sequentially transferred to a transfer paper which is held on and rotated together with a transfer drum. The control device includes a paper size setting circuit for setting the size of a transfer paper to be used before a copying operation, a scanning sensor for sensing the start of a scanning performed by the optical system, and a home sensor for sensing the instantaneous angular position of the transfer drum. A control circuit is constructed to determine a transfer start time and a transfer end time in response to a paper size signal outputted by the paper size setting circuit, an ouput signal of the scanning sensor, and an output of the home sensor, and to variably control the rotation speed of the transfer drum during the interval between the transfer start and transfer end times so as to align the leading end of a transfer paper loaded on the transfer drum and the leading end of each of the toner images formed on the photoconductive drum and different in color from each other.

5 Claims, 6 Drawing Figures

| |
|---|
| Fig. 5A |
| Fig. 5B |

CONTROL SYSTEM FOR COLOR COPIER

BACKGROUND OF THE INVENTION

The present invention relates to a control system for a color copier which sets up an adequate color copying time for transfer papers of any particular size.

A typical color copier known in the art includes an optical system for scanning a document, a photoconductive drum, and a transfer drum located to face and in contact with the photoconductive drum. The photoconductive drum is sequentially exposed to a plurality of color components which are separated by the optical system and representative of a color document. Each of the resulting latent images is developed by a toner which is complementary in color to the latent image. The toner images are sequentially transferred to a transfer paper which is held on and rotated together with the drum. In this type of color copier, a prerequisite is that the optical system, photoconductive drum and transfer drum be driven in synchronism in order to eliminate the deviation of colors on the paper, which is detrimental to the quality of reproduction. To meet this requirement, there may be used a system in which a drive source of the photoconductive drum and that of the transfer drum are interconnected by gears and others which encounter a minimum of backlash, while the optical system is driven by a servo motor or the like which shows rapid response during speed control. However, a problem with such a system is that even when the size of papers is small a substantial period of time is necessary for a copy to be produced.

A control system capable of setting up an adequate copying time which matches itself to a transfer paper size is disclosed in Japanese Laid-Open Patent Publication (Kokai) No. 60-218673. The system disclosed uses a scanning sensor responsive to a scan start position of the optical system, and a paper sensor disposed near the transfer drum to sense the trailing end of a transfer paper loaded on the drum. The times at which a transfer is started and ended are determined on the basis of the output signal of the scanning sensor and that of the paper sensor, respectively. During the interval between the times of the start and end of transfer determined, the rotation speed of the transfer drum is variably controlled to align the leading end of a transfer paper and that of each toner image representative of a particular color component.

Such a prior art system, however, cannot be accomplished without increasing the cost because the paper sensor responsive to the trailing end of a paper has to be associated with the transfer drum. Further, the accuracy of detection attainable with the paper sensor is limited and, therefore, the entire system lacks reliability.

SUMMARY OF THE INVENTION

It is therefore an object of the present invention to provide a control device for a color copier which is simple in construction and, yet, capable of controlling the operation of the copier based on information for setting up an adequate copying time associated with a transfer paper size.

It is another object of the present invention to provide a generally improved control device for a color copier.

A control system for a color copier having a scanning optical system, a photoconductive drum and a transfer drum of the present invention comprises a paper size setting circuit for setting the size of a transfer paper to be used before a copying operation, a scanning sensor for sensing the start of a scanning performed by the optical system, a home sensor for sensing the instantaneous angular position of the transfer drum, and a control circuit for determining a transfer start time and a transfer end time in response to a paper size signal outputted by the paper size setting circuit, an output signal of the scanning sensor, and an output of the home sensor, and variably controlling the rotation speed of the transfer drum during the interval between the transfer start and transfer end times so as to align the leading end of a transfer paper loaded on the transfer drum and the leading end of each of toner images formed on the photoconductive drum and different in color from each other.

The above and other objects, features and advantages of the present invention will become more apparent from the following detailed description taken with the accompanying drawings.

DESCRIPTION OF THE PREFERRED EMBODIMENT

To better understand the present invention, a brief reference will be made of a prior art color copier, particularly the control system disclosed in Japanese Laid-Open Patent Publication (Kokai) No. 60-218637 as previously mentioned, shown in FIG. 1.

Figure 1:
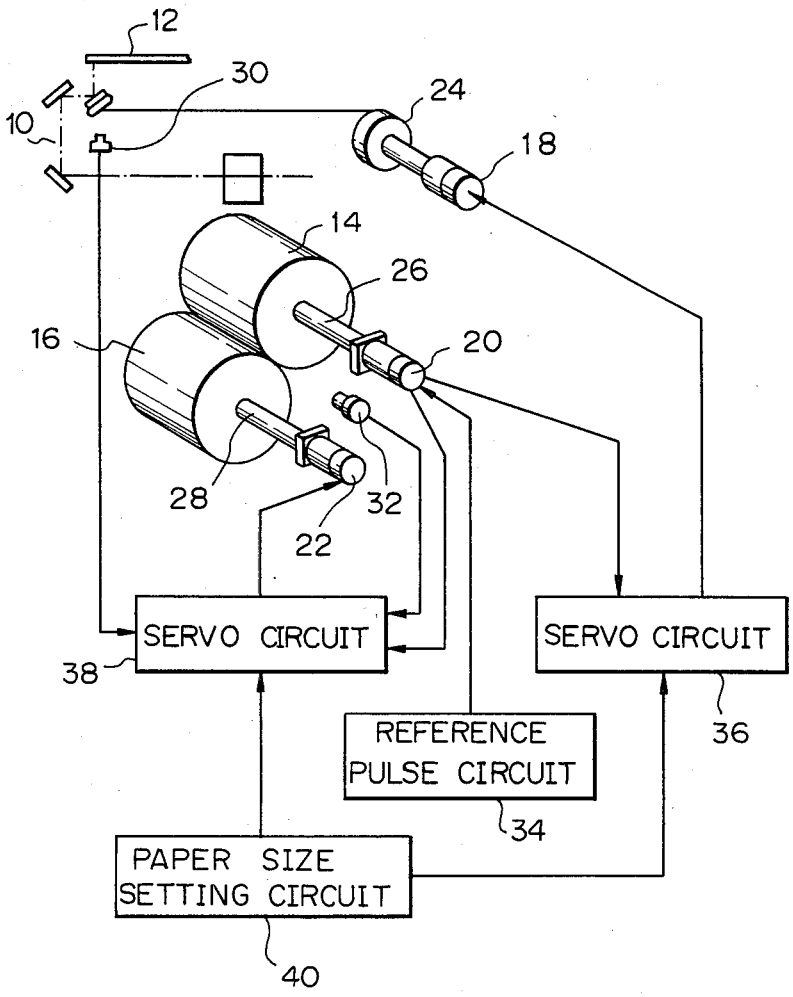
Fig. 1 PRIOR ART
FIG. 1 is a schematic perspective view of a prior art color copier.

As shown in FIG. 1, the prior art system basically includes a scanning optical system 10 for repetitively scanning a color document 12, and a single photoconductive drum 14 which is rotated at a constant speed and sequentially exposed to a plurality of color components representative of the document. Every time a latent image is electrostatically formed on the drum 14 by the above procedure, it is developed by a toner of a complementary color to that associated with the latent image. The resulting toner images are sequentially transferred to a transfer paper which is held by a transfer drum 16, which is rotated in contact with the photoconductive drum 14. A servo motor 18 is drivably connected to the optical system 10 by a capstan shaft 24. Likewise, servo motors 20 and 22 are drivably connected to the drums 14 and 16 by rotary shafts 26 and 28, respectively. The servo motor 18 is reversible because the optical system 10 has to be moved in a reciprocating motion.

A scanning sensor 30 is provided for sensing the position (home position) of a lamp and others within a scanning mechanism before the start of a scanning stroke, i.e., a scan start position of the optical system 10. Also provided is a paper sensor 32 which is located in the vicinity of the transfer drum 16 to sense the trailing end of the paper loaded on the drum 16. A control system of the color copier includes a reference pulse circuit 34 for generating reference pulses which cause the servo motor 20 associated with the photoconductive drum 14 to be rotated at a constant speed, servo circuits 36 and 38 for controllably driving the other servo motors 18 and 22 in relation to the servo motor 20, and a paper size setting circuit 40 for delivering a paper size command to the servo circuits 36 and 38.

With the above construction, the system determines the times when a transfer has started and ended in response to the output signals of the sensors 30 and 32. During the interval between those times determined, the rotation speed of the transfer drum 16 is variably controlled so as to align the leading end of the paper on the drum 16 and that of each toner image on the drum 14. Specifically, it is not that the scanning and exposure is started at the same position for all the images of different colors by awaiting the completion of one full rotation of the drum 14, but that as soon as the scan-back (return) of the optical system 10 is completed the next scanning begins to expose the drum 14 imagewise. Hence, the scanning stroke becomes as short as the size of transfer papers. The rotation speed of the drum 16 is controlled independently of the drum 14 in order to eliminate the deviation of images transferred.

However, as previously stated, such a prior art system cannot be accomplished without increasing the cost because the paper sensor responsive to the trailing end of a paper has to be associated with the transfer drum. Further, the accuracy of detection attainable with the paper sensor is limited and, therefore, the entire system lacks reliability.

A color copier embodying the present invention and which is free from the drawabaks discussed above will be described with reference to FIGS. 2 to 6.

Figure 2:
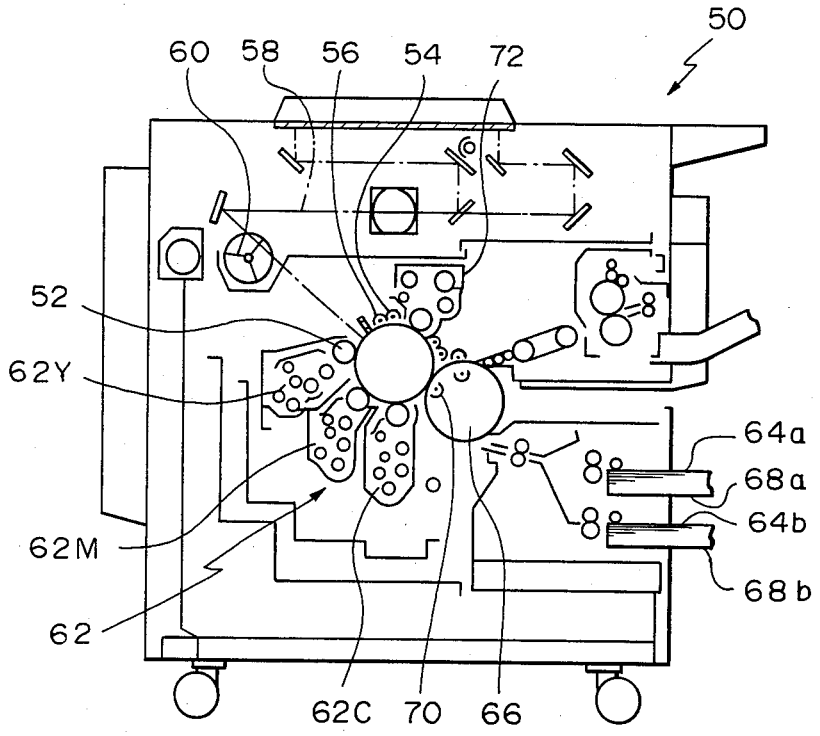
FIG. 2 is a schematic front view of a color copier in accordance with the present invention.

Referring to FIG. 2, the color copier, generally 50, includes a photoconductive drum 52 which is located in a central part inside of a housing of the copier. A charger 54 and an eraser 56 are arranged around the drum 52. A scanning optical system 58 is disposed above the drum 52. The optical system 58 is constructed as well known in the art and, as shown in FIG. 2, made up of a lamp, mirrors, a lens and others. The optical system 58 repetitively performs a scanning stroke from a home position as indicated by solid lines to a position (a length corresponding to that of a document) as indicated by phantom lines, and a return stroke from the latter to the former in the opposite direction. A color filter 60 adapted for the separation of colors is disposed in the optical path of the optical system 58. A developing device 62 is located next to a position where an image is formed by the optical system 58. As shown, the developing device 62 consists of a magenta developing unit 62M, a cyan developing unit 62C and a yellow developing unit 62Y which are adapted for color copying. Located next to the device 62 is a hollow transfer drum 66 which is rotatable with any of transfer paper **64*a* and 64*b* loaded thereon. Specifically, any of the papers 64*a* and 64*b* which are different in size and fed from cassettes 68*a* and 68*b*, respectively, is clamped by the drum 66 to undergo a plurality of consecutive times of transfer. A transfer charger 70 is disposed in the hollow drum 66. The reference numeral 72** designates a cleaning device.

Basically, the operation of the color copier 50 comprises the steps of: causing the optical system 58 to repetitively scan a color document to sequentially expose the photoconductive drum 52, which is rotated at a constant speed, to a plurality of different color components which are representative of the document, developing each of the resulting latent images on the drum 52 by supplying from the developing device 62 a toner whose color is complementary to that of the color component, and sequentially transferring the toner images onto the paper **68*a* or 68*b* which is held by the drum 66**.

Figure 3:
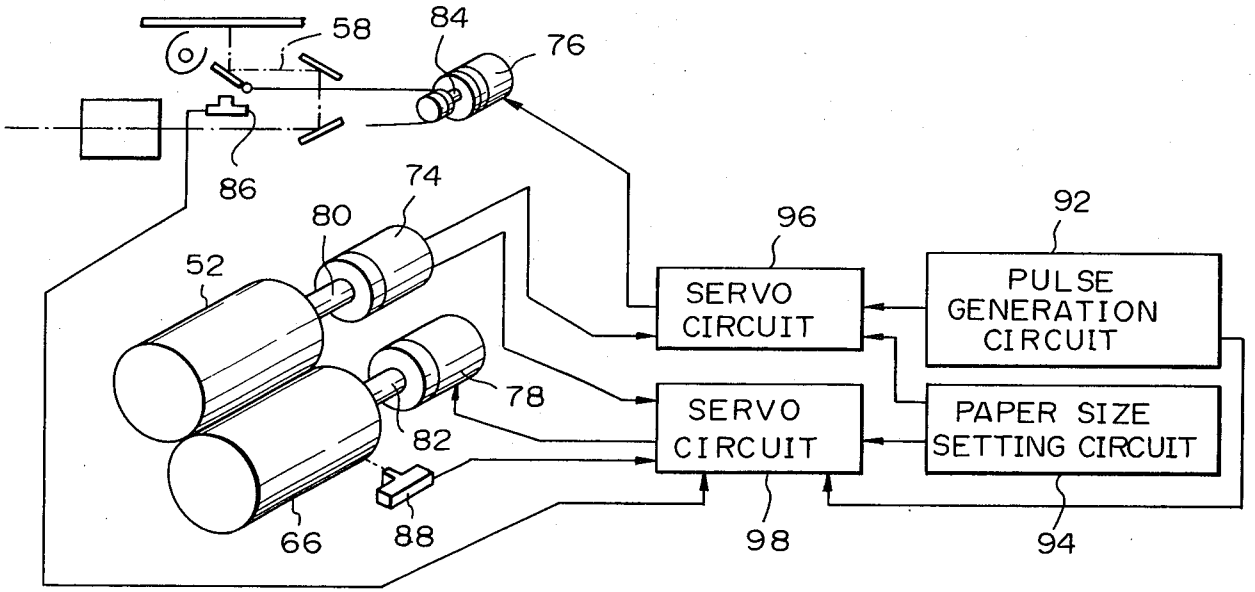
FIG. 3 is a fragmentary perspective view schematically showing the color copier FIG. 2.
Figure 4:
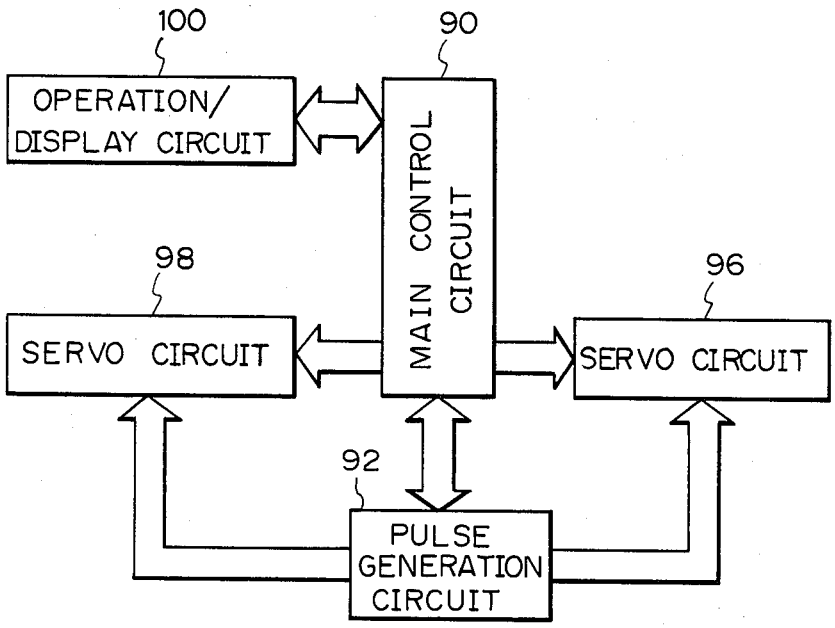
FIG. 4 is a block diagram of a control system which is built in the color copier of FIG. 2.

Referring to FIGS. 3 and 4, a drive system and a control system for the photoconductive drum 52, optical system 58 and transfer drum 66 are shown. Servo motors 74, 76 and 78 are drivably connected to the drum 52, optical system 58 and drum 66 by a rotary shaft 80, a capstan shaft 84 and a rotary shaft 82, respectively. As in the prior art system, a scanning sensor 86 is provided for sensing the time at which the optical system starts a scanning stroke (i.e. home position). The transfer drum 66 is provided with a home sensor 88 which is adapted to sense the positions (conditions) of the drum 66 for controlling the motions of the drum 66, e.g. paper clamp timing.

Further, as shown in FIG. 4, a main control circuit 90 is provided to control all the loads except for the transfer drum 66 and optical system 58. The operation timings of each of the loads are controlled on the basis of reference pulses. A pulse generation circuit 92 generates pulses necessary for controllably driving the servo motors 76 and 78 in response to the reference pulses which are generated inside of the main control circuit 90. A paper size setting circuit 94 is connected to servo circuits 96 and 98, which are respectively associated with the servo motors 76 and 78, in order to deliver a command which is representative of the size of the papers **64*a* and 64*b* used. In the block diagram of FIG. 4, the paper size setting circuit 84 constitutes a part of an operation and display circuit 100 and is therefore connected to the main control circuit 90**.

As shown and described, what clearly distinguishes this embodiment from the prior art system is that the transfer drum 66 is not provided with an extra sensor, i.e., paper sensor and, instead, controlled on the basis of the output of the existing home sensor 88. Specifically, all the loads except for the transfer drum 66 and optical system 58 are controlled by the main control circuit 90 based on the reference pulses, as previously stated. While the optical system 58 is controlled by the servo circuit 96, the main control circuit 90 can grasp the periods of time, i.e., timings associated with the scanning speed and the returning speed of the optical system 58 if the size of a document to be duplicated is known beforehand. Likewise, while the transfer drum 66 is controlled by the servo circuit 98, the main control circuit 90 can determine an instantaneous condition of the drum 66 based on the output of the home sensor 88.

Figure 6:
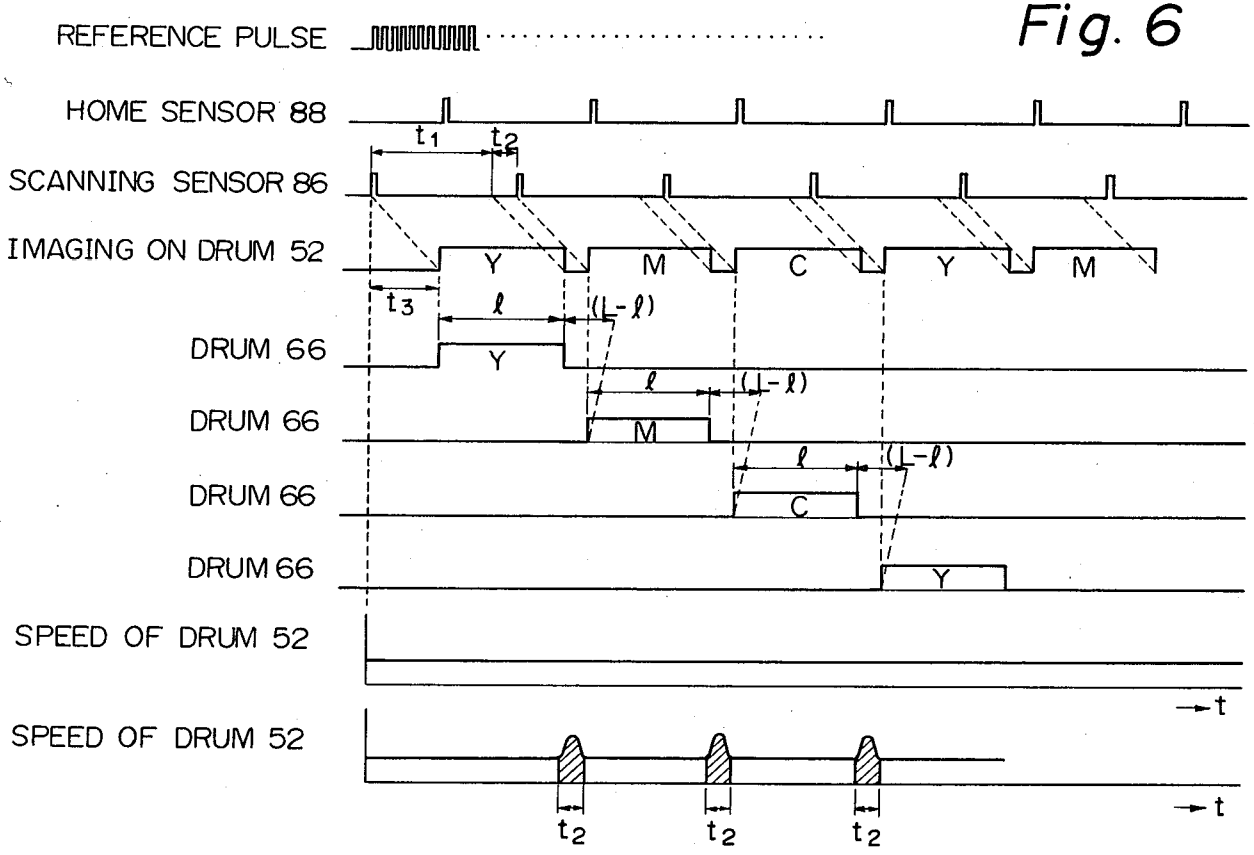
FIG. 6 is a timing chart also demonstrating the operation of the control system in relation to FIG. 5.

When the toner images of colors M, C and Y provided by the developing device 62 are to be laid one upon another on the transfer paper **64*a* or 64*b*, it is important that the leading end of the paper 64*a* or 64*b* on the transfer drum 66 be coincident in timing with the start of document scanning. It follows that the rotation speed of the drum 66 must be controlled to align the leading end of the paper 64*a* or 64*b* with the that of each toner image which is formed on the photoconductive drum 52. In this instance, the main control circuit 90 can see the size (length) l, the circumferential length L of the drum 66, the scanning time $t_1$ and the returning time $t_2$ of the optical system 58, the angular distance R by which the drum 52 is rotated during the return of the optical system 58, and the rotation speed $V_0$ of the drum 52, as shown in FIG. 6, even if a paper sensor used with the prior art system is absent. That is, so long as the main control circuit 90 controls the timings of a sequence of copying steps such as discharging, charging, exposing, developing, transferring, separating and fixing in response to the output of the home sensor and the reference pulses, it can see the times to begin and end a speed control on the drum 66, and the scanning time and the returning time of the optical system 58. Consequently, the drum 66 can be rotated by an angular distance of (L−l) while the optical system 58** is returned.

In the manner described, the start and the stop of a transfer is controlled by the main control circuit 90. The time when a transfer is ended is delivered to the servo circuit 98 so that the rotation speed of the transfer drum 66 is controlled over the subsequent period of time $t_2$ to move the drum 66 by the distance of (L−l).

Figures 5, 5A:
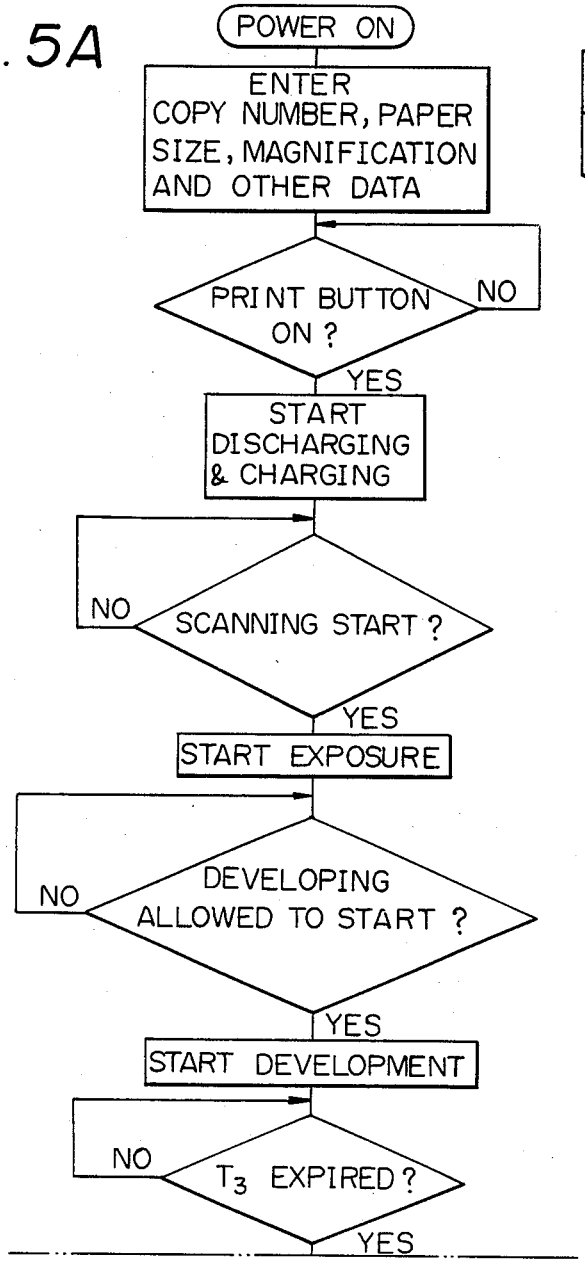
FIG. 5 is a flowchart demonstrating the operation of the control system as shown in FIG. 4.
Figure 5B:
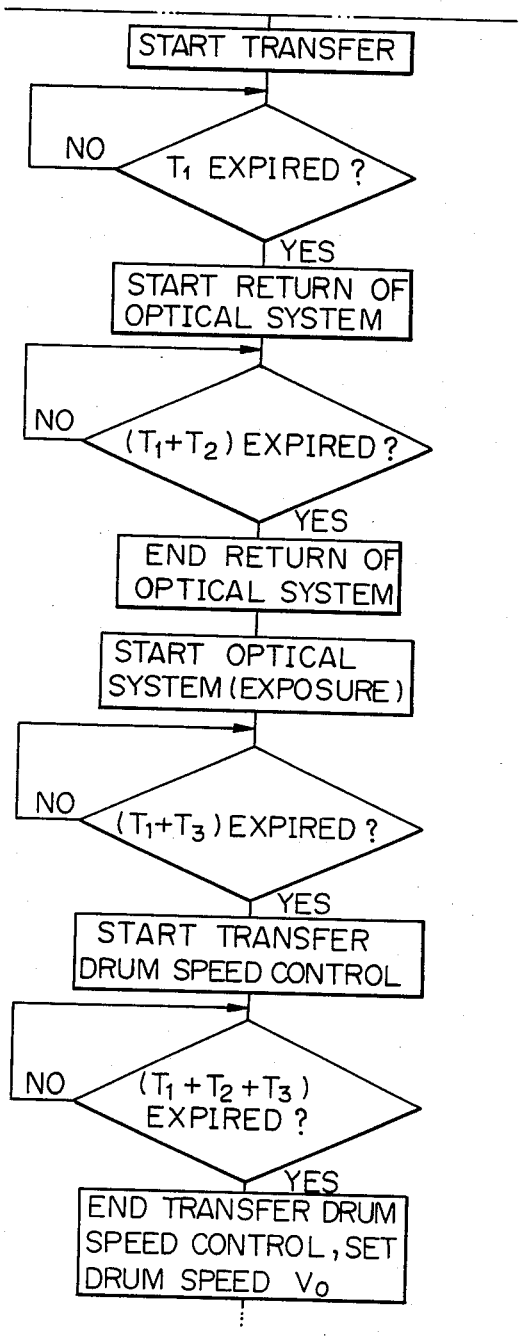

The operation and the operation control stated above will be explained with reference to FIGS. 5 and 6. FIG. 5 is a flowchart demonstrating an operation control which is performed in a color copy mode. FIG. 6 is a timing chart showing, in conformity to FIG. 5, a relationship between the timings for the images Y, M and C to be formed on the drum 52 and the operation timings of the drum 66, both of which are controlled on the basis of the reference pulses, the output of the home sensor 88 associated with the drum 66 and the output of the scanning sensor 88, as well as a relationship between the drums 52 and 66 in terms of speed. In FIG. 6, L denotes the circumferential length of the drum 66 (equal to that of the drum 52), l the length of the paper 64*a* or 64*b* set by the circuit 94, and R the returning length of the optical system 58, as previously mentioned.

In a color copy mode, various data such as the desired number of copies and the magnification are entered while, at the same time, the size (length) of the papers 64*a* or 64*b* is entered through the paper size setting circuit 94. As a print button of the copier is depressed to start a copying operation, the photoconductive drum 52 is discharged and, then, charged. When a start timing of the optical system 58 is reached, the optical system 58 begins to scan a document (this timing is sensed by the scanning sensor 86) so that a latent image representative of a particular color component is electrostatically formed on the drum 52, which is rotating at a constant speed $V_0$. when a development timing is reached, the latent image is developed by one of the developing units 62Y, 62M and 62C which contains a toner complementary in color to the latent image. Upon the lapse of a period of time $t_3$ since the time when the optical system 58 has started the scanning, the transfer of the toner image from the drum 52 to the paper 64*a* or 64*b* on the drum 66 begins. The period of time $t_3$ is adapted for an accurate transfer timing. At this instant, the drum 66 is rotating at the same speed, $V_0$, as the drum 52. At the end of the period of time $t_3$, the drum 66 has assumed its reference position as sensed by the home sensor 88 and the paper 64*a* or 64*b* on the drum 66 has been aligned at its leading end with the leading end of the toner image.

Meanwhile, upon the lapse of a period of time $t_1$ (corresponding to a length associated with the document size and the paper size) after the start of the scanning, the scanning is completed so that the servo motor 76 begins to be rotated in the opposite direction to return the optical system 58. As a period of time $(t_1+t_2)$ expires after the start of the scanning, the return of the optical system 58 is completed. Then, the servo motor 76 is driven forward to cause the optical system 58 to start another scanning stroke immediately. This allows a latent image representative of the next color component to be formed on the drum 52 without awaiting the completion of one full rotation of the drum 52. The scanning of this time differs from that of the last time in that, when the time to complete the transfer is reached after a period of time $(t_1+t_3)$, the rotation speed of the drum 66 is variably controlled until the next transfer start timing such that the drum 66 rotates at a higher speed than the drum 52. This, as considered on the drum 52, occurs within the returning time $t_2$ of the optical system 58, and the paper is moved by the length of (L−l) during that period of time. Upon the lapse of a period of time $(t_1+t_2+t_3)$, i.e., when the time to start a transfer is reached, the variable control over the speed of the drum 66 is terminated to drive the drum 66 at the same speed, $V_0$, as the drum 52.

The control procedure described above is repeated thereafter.

As shown in FIG. 6, among the various controls which are based on the reference pulses, the control of the transfer start timing and that of the transfer end timing are performed in response to the output of the home sensor 88 representative of an instantaneous position of the drum 66 and the output of the scanning sensor 86 representative of a scanning start timing. During the interval between the end of one transfer and the start of the next transfer, the rotation speed of the drum 66 is variably controlled to bring the leading end of the paper 64*a* or 64*b* into alignment with that of a toner image. So far as the relationship between the speed of the drum 52 and that of the drum 66 as shown in FIG. 6 is concerned, the variable control is such that the drum 66 is moved by the angular distance of (L−l) within the returning time $t_2$ and by an integrated value as indicated by hatching in FIG. 6.

In summary, it will be seen that a control system for a color copier of the present invention sets up an adequate color copying time for any particular paper size with a simple, inexpensive and reliable construction, thereby enhancing efficient copying operations.

Various modifications will become possible for those skilled in the art after receiving the teachings of the present disclosure without departing from the scope thereof.

What is claimed is:

1. A control system for a color copier having a scanning optical system, a photoconductive drum and a transfer drum, comprising:

a paper size setting means for setting a size of a transfer paper to be used before a copying operation;

a scanning sensor means for sensing a start of a scanning performed by said optical system;

a home sensor means for sensing an instantaneous angular position of said transfer drum; and a control means for determining a transfer start time and a transfer end time in response to a paper size signal outputted by said paper size setting means, an output signal of said scanning sensor means, and an output of said home sensor means, and variably controlling a rotation speed of said transfer drum during an interval between said transfer start and transfer end times so as to align a leading end of a transfer paper loaded on said transfer drum and a leading end of each of toner images formed on said photoconductive drum and different in color from each other.

2. A control device as claimed in claim 1, further comprising drive means for driving said optical system, photoconductive drum and transfer drum independently of each other.

3. A control device as claimed in claim 2, wherein each of said drive means comprises a servo motor.

4. A control device as claimed in claim 3, further comprising servo circuits for controlling the drive of said motors independently of each other.

5. A control device as claimed in claim 4, further comprising a pulse generation circuit for generating reference pulses.

* * * * *